US008468735B1

(12) United States Patent
Keng et al.

(10) Patent No.: US 8,468,735 B1
(45) Date of Patent: Jun. 25, 2013

(54) FIREARM AUXILIARY REAR SIGHT

(75) Inventors: Da Keng, Smyrna, GA (US); Alvin Williams, Atlanta, GA (US)

(73) Assignee: Keng's Firearms Specialty, Inc., Atlanta, GA (US)

( * ) Notice: Subject to any disclaimer, the term of this patent is extended or adjusted under 35 U.S.C. 154(b) by 200 days.

(21) Appl. No.: 13/136,605

(22) Filed: Aug. 8, 2011

Related U.S. Application Data

(60) Provisional application No. 61/519,879, filed on Jun. 1, 2011.

(51) Int. Cl.
*F41G 1/06* (2006.01)

(52) U.S. Cl.
USPC ..... 42/148

(58) Field of Classification Search
USPC ..... 42/148
See application file for complete search history.

(56) References Cited

U.S. PATENT DOCUMENTS

| | | | | |
|---|---|---|---|---|
| 4,597,211 | A * | 7/1986 | Miles | 42/112 |
| 5,918,374 | A * | 7/1999 | Campbell et al. | 42/137 |
| 7,526,890 | B1 * | 5/2009 | Keng et al. | 42/136 |
| 7,694,450 | B2 * | 4/2010 | Keng | 42/124 |
| 7,739,824 | B1 * | 6/2010 | Swan | 42/124 |
| 7,743,546 | B2 * | 6/2010 | Keng | 42/145 |
| 7,814,698 | B2 * | 10/2010 | Fluhr et al. | 42/127 |
| 8,015,744 | B1 * | 9/2011 | Swan | 42/147 |
| 8,112,933 | B1 * | 2/2012 | Swan | 42/127 |
| 2006/0207157 | A1 * | 9/2006 | Keng | 42/132 |
| 2007/0271834 | A1 * | 11/2007 | Keng | 42/124 |
| 2008/0072471 | A1 * | 3/2008 | Keng | 42/124 |
| 2008/0092423 | A1 * | 4/2008 | Keng | 42/111 |
| 2008/0092424 | A1 * | 4/2008 | Keng | 42/137 |
| 2012/0210624 | A1 * | 8/2012 | Schneider et al. | 42/90 |
| 2012/0317862 | A1 * | 12/2012 | Samson et al. | 42/125 |
| 2013/0000176 | A1 * | 1/2013 | Goertzen | 42/90 |
| 2013/0036650 | A1 * | 2/2013 | Larue | 42/148 |

* cited by examiner

*Primary Examiner* — Michael David
(74) *Attorney, Agent, or Firm* — Rodgers & Rodgers

(57) ABSTRACT

A firearm auxiliary sight is stored below the firearm optical sight and quickly deployable by means of activation of a lever which disengages the sight whereby a spring moves it outwardly from a housing. During deployment the auxiliary sight is rotated to an angle of 45 degrees with respect to the firearm and simultaneously the sight aperture is rotated upwardly.

16 Claims, 4 Drawing Sheets

FIREARM AUXILIARY REAR SIGHT

The benefits under 35 U.S.C. 119 are claimed of provisional patent application 61/519,879 filed Jun. 1, 2011.

BACKGROUND OF THE INVENTION

Advanced Combat Optical Gunsights (ACOG) are a series of telescopic sights designed and used on the M16 rifle and M4 carbine. The ACOG's reticle is illuminated by an internal phosphor illuminated by the radioactive decay of tritium. The sights are standard issue for the United States Army and United States Marine Corps for use in connection with the M16 and M4 and are utilized for target acquisition and shooting accuracy under stressful conditions such as combat. Modern day optical sights are extremely delicate and prone to failure under harsh conditions especially in cases such as when the firearm is dropped, repeated recoil and rough handling in general.

When the principal optical sight fails, there is generally insufficient time to replace the sight and, therefore, the need arises for an auxiliary backup sight which is unobtrusively mounted on the firearm when not in use and easily and quickly deployable as needed when the primary optical sight becomes inoperable.

BRIEF SUMMARY OF THE INVENTION

This invention includes an auxiliary rear firearm sight which is stored out of the way between the optical sight and the firearm. The auxiliary rear sight is deployed by actuation of a lever which releases the auxiliary sight and then a spring forces the auxiliary sight from an enclosure outwardly and into a 45-degree angle with respect to the vertical axis of the firearm and, simultaneously, the sight aperture is elevated into its operational position by means of a spring. When not in use, the auxiliary rear sight is manually pushed into its enclosure and locked into position underneath the optical sight.

DETAILED DESCRIPTION OF THE INVENTION

Figure 1:
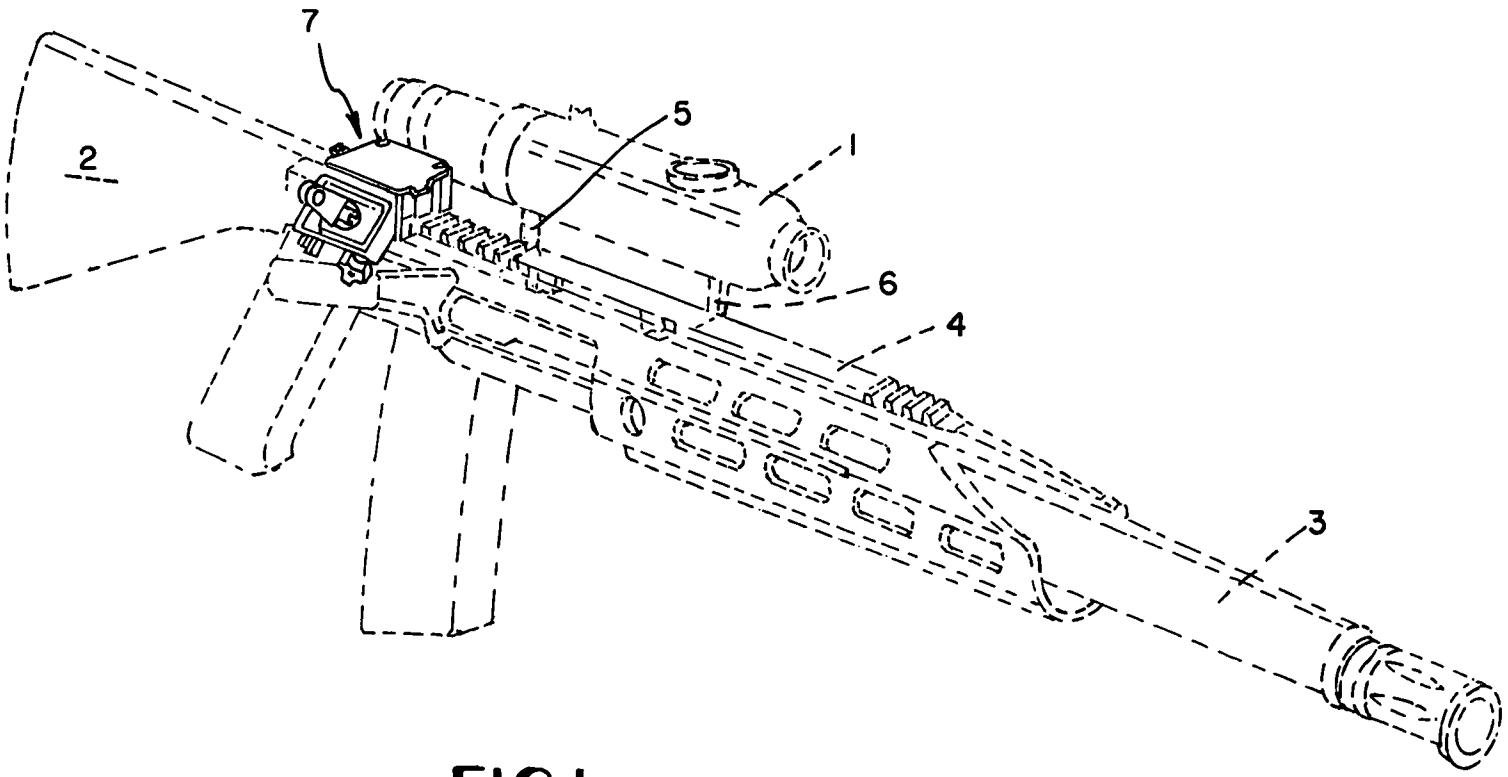
FIG. 1 is a perspective view of a firearm with an optical sight, shown in dotted lines, and with the auxiliary rear sight, according to this invention, shown in a deployed condition.
Figure 2:
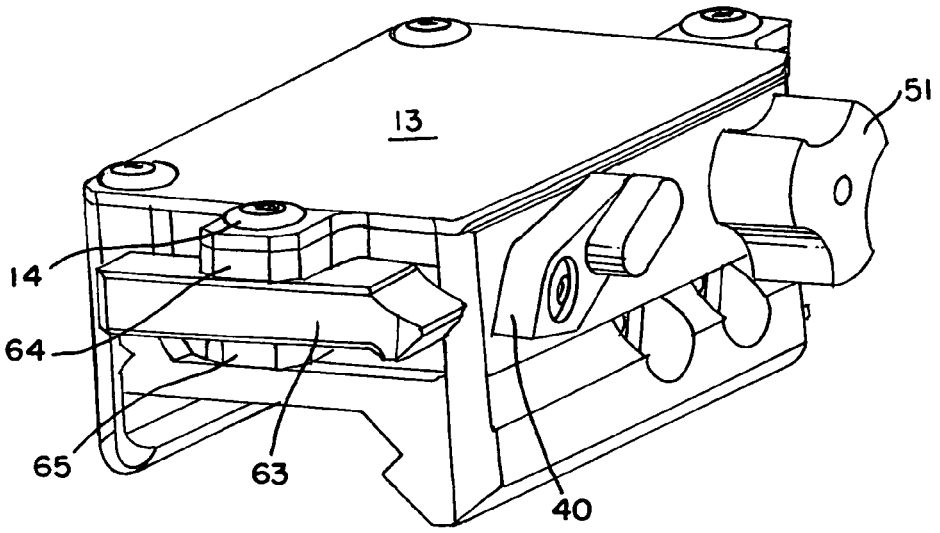
FIGS. 2, 3, 4 and 5 show successive stages in the deployment of the auxiliary sight from its stored condition to being fully operational.
Figure 3:
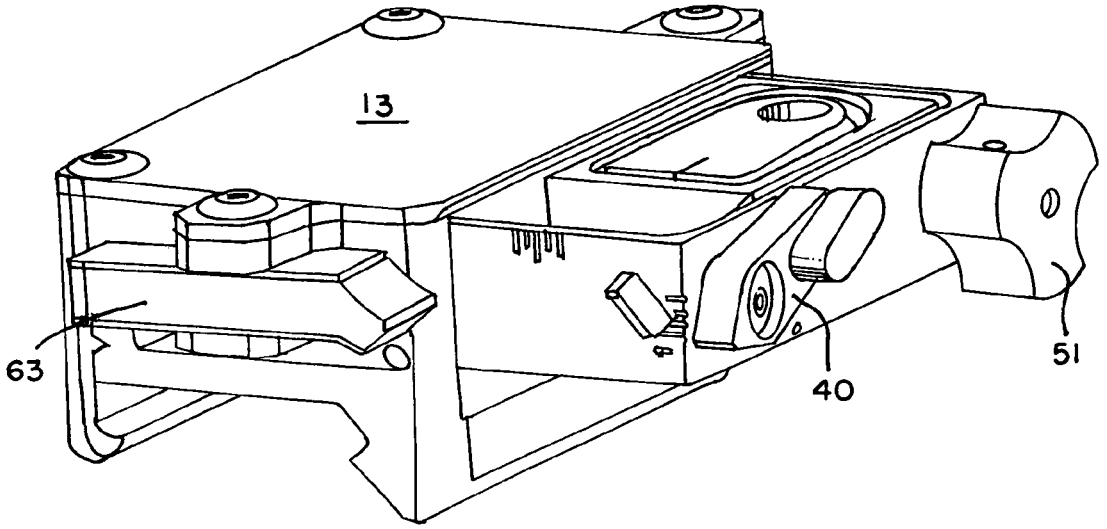
Figure 4:
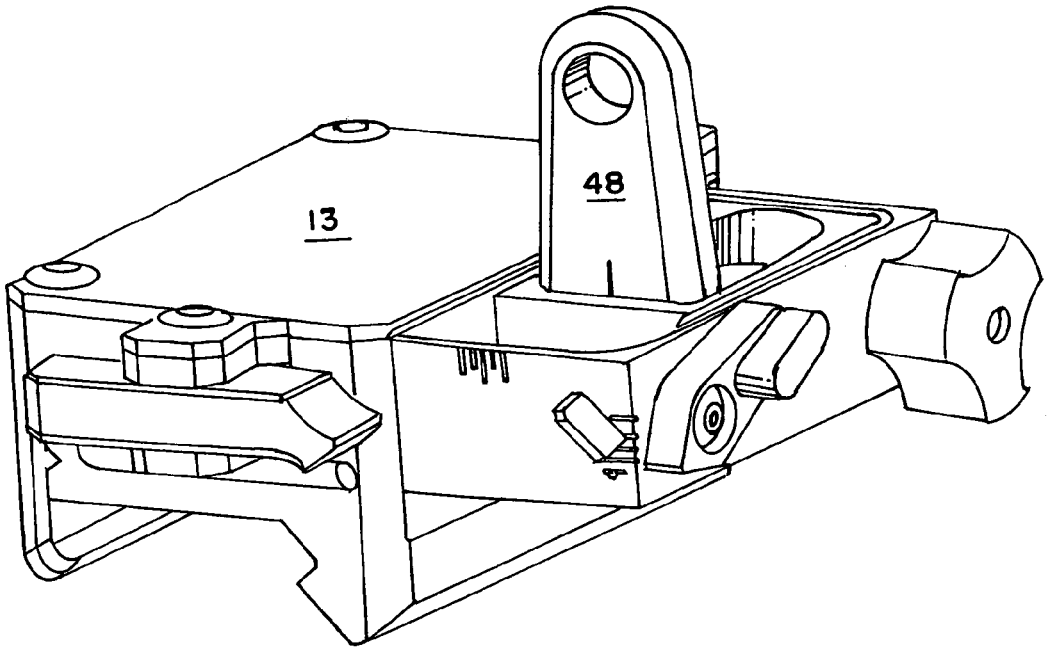

In the drawings, and with particular reference to FIG. 1, a conventional firearm is shown which includes the basic features of optical sight 1, stock 2, barrel 3 and Picatinny rail 4 all of which are well known in the art. Optical sight 1 is attached to Picatinny rail 4 by means of brackets 5 and 6 and the portion of optical sight 1 extending rearwardly of bracket 5 is spaced vertically from the firearm disposed therebelow. This open space provides for the placement of the auxiliary rear sight, according to this invention, which is generally designated by the numeral 7. Auxiliary rear sight 7 is shown in FIG. 1 as being fully deployed, but when not deployed the auxiliary rear sight is stored below optical sight 1 in an out of the way and unobtrusive disposition. When primary optical sight 1 fails, auxiliary rear sight 7 is quickly and efficiently deployed in a single motion so that the user is not left with a firearm without a functioning rear sight.

Figure 6:
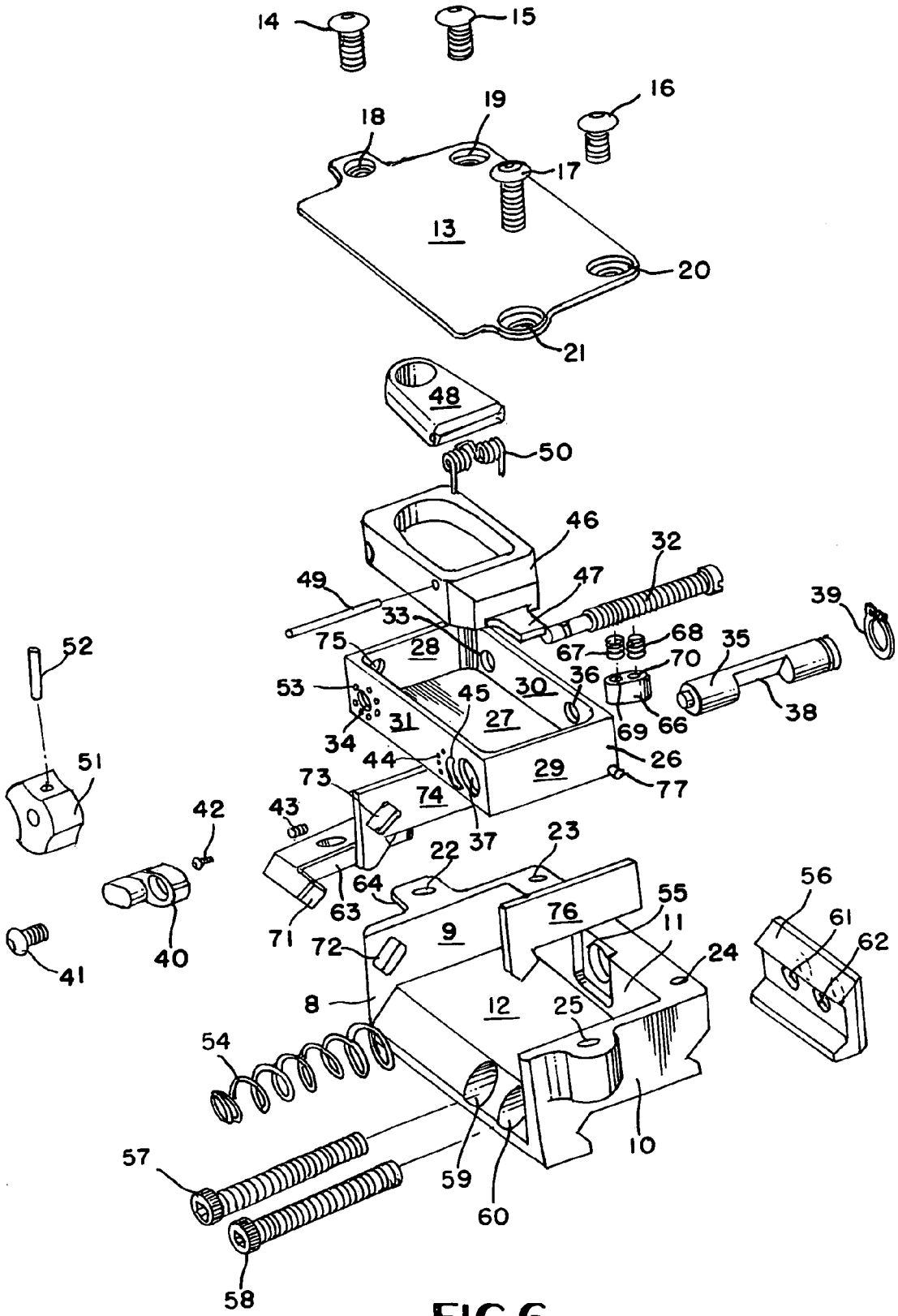
FIG. 6 is an exploded perspective view of the auxiliary rear sight.

The specific features of auxiliary rear sight 7 are shown in more detail in FIG. 6 and include housing 8 having end walls 9 and 10 and side wall 11 interconnected to form the upright walled feature of the housing enclosure which is open on one side. In addition, bottom 12 is interconnected to the lower edges of end walls 9 and 10 and side wall 11 and top 13 is secured to the upper edges end walls 9 and 10 and side wall 11 by means of screws 14-17 which are inserted through apertures 18-21, respectively, and then into threaded apertures 22-25, respectively, to complete the basic elements of housing 8. According to a feature of this invention, the edge of bottom 12 disposed remote from side wall 11 is sloped downwardly at an angle of 45 degrees.

As best viewed in FIG. 6, sight base mount 26 is slidably disposed in housing 8 and includes bottom 27 with interconnected end walls 28 and 29 and side walls 30 and 31 upstanding therefrom. Windage screw 32 is inserted through apertures 33 and 34 of base mount 26 and, similarly, elevation lever shaft 35 is inserted through apertures 36 and 37 of base mount 26. In addition, notch 38 is formed in elevation lever shaft 35. Attachment cap 39 is formed on one end of elevation lever shaft 35 with elevation lever 40 attached to the opposite end by means of screw 41 and incrementally rotatable by means of pins 42 and 43 which cooperate with detents 44 and curved slot 45, respectively, as is well known.

Further, sight base 46 is disposed within base mount 26 and includes tab 47 extending from one end thereof. Sight aperture 48 is rotatably mounted within base mount 26 by means of pin 49 and is elevated from its position within sight base 46 by means of spring 50.

In order to adjust the rear sight for varying wind conditions and as well known, windage knob 51 is secured to the end of windage screw 32 disposed adjacent aperture 34 by means of threaded pin 52. In actual use, windage knob 51 is rotated incrementally for the purpose of adjusting the sight laterally by means of a ball bearing disposed in a detent formed on the inside surface of windage knob 51 and by which the ball bearing enters one of the detents 53 formed in base mount 26 and positioned around aperture 34.

For the purpose of moving base mount 26 outwardly of housing 8, coil spring 54 is disposed in detent 55 in a compressed configuration between side wall 11 and the adjacent side wall 30 of base mount 26.

In order to attach auxiliary rear sight 7 to a firearm, Picatinny attachment plate 56 is provided and is utilized to interconnect auxiliary rear sight 7 to Picatinny rail 4, as is well known, by means of screws 57 and 58 which are insertable through apertures 59 and 60, respectively, and further through apertures 61 and 62, respectively, in known manner.

To complete the various elements of auxiliary rear sight 7, lever 63 is pivotally secured to housing 8 by means of screw 14 which extends through aperture 22 formed in tab 64 which in turn extends outwardly from the upper edge of end wall 9. A second tab 65 is positioned below and spaced from tab 64 to receive screw 14 and with lever 63 rotatably disposed therebetween.

In order to provide upward tension on sight base 46, dowel 66 is provided and is positioned in an aperture (not shown) formed on the underside of sight base 46 with tension exerted thereon by means of springs 67 and 68 disposed, respectively, in apertures 69 and 70 of dowel 66.

In its stowed condition, base mount 26 is urged outwardly toward the open side of housing 8 by means of spring 54 which is compressed in detent 55. Base mount 26 is prevented from sliding outwardly by finger 71 which extends perpendicularly inward to the axis of lever 63 and into aperture 72 formed in the adjacent end wall 9 of housing 8 and then through aperture 73 formed in plate 74 and finally through aperture 75 formed in end wall 28 of base mount 26. By the releasable interconnection between finger 71 and aperture 75 of end wall 28, base mount 26 is prevented from outward movement.

In order for base mount 26 to slide reliably outwardly of housing 8, plates 74 and 76 are disposed in face contacting relation, respectively, with the inner surfaces of end walls 9 and 10 of housing 8 with the lower edges of plates 74 and 76 spaced from the upper surface of bottom 12. Also, pin 77 extends outwardly from the inside lower corner of end wall 29 and a corresponding pin extends outwardly from end wall 28 which is not viewable in FIG. 6.

Figure 5:
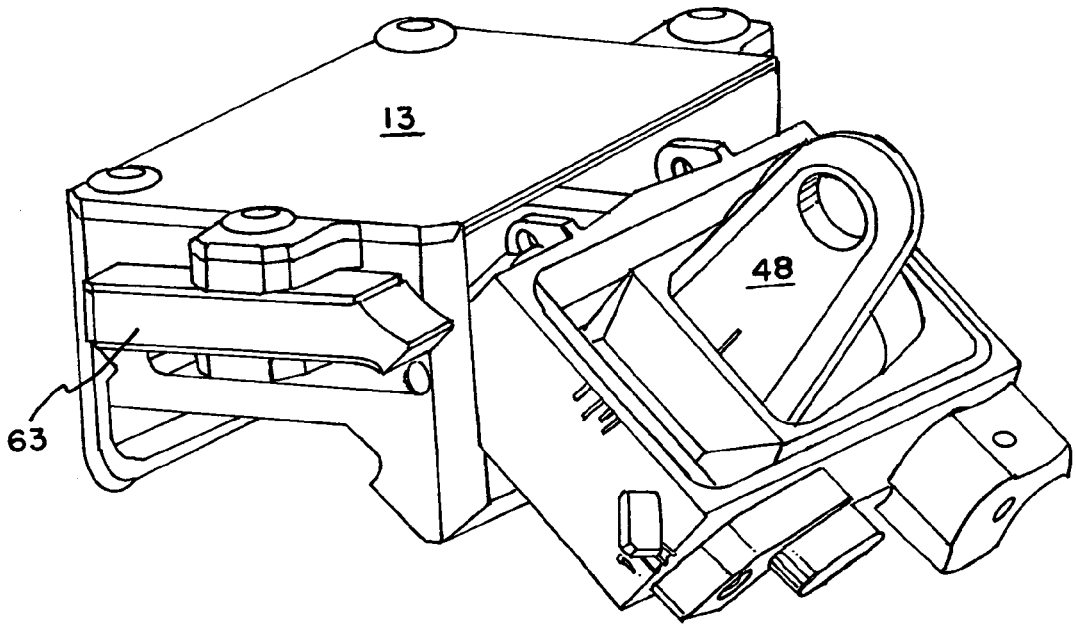

In operation, when it is desired to deploy the auxiliary sight according to this invention, lever 63 is depressed at the end remote from finger 71 such that finger 71 rotates outwardly through apertures 75, 73 and 72 a sufficient distance to release base mount 26 and thereby allow spring 54 to move base mount 26 outwardly through the open side of housing 8. As base mount 26 moves outwardly, the action of spring 54 causes base mount 26 to rotate downwardly to a position whereby the bottom of base mount 26 is in face contacting relation with the front angled edge of bottom 12. Simultaneously with this operation, spring 50 causes sight aperture 48 to rotate upwardly into position. The auxiliary sight is then fully deployed as shown in FIGS. 1 and 5 and, as is well known, windage and elevation adjustments are made by manipulation of windage knob 51 and elevation lever 40.

The invention claimed is:

1. A firearm auxiliary sight comprising a housing, said housing comprising a bottom and multiple walls upstanding therefrom, an opening between the ends of two of said walls, the edge of said bottom disposed at said opening being angled downwardly, a base mount disposed in said housing, said base mount being biased through said opening by means of a spring, said base mount being releasably secured in said opening by means of a lever pivotally mounted on said housing.

2. A firearm auxiliary sight according to claim 1 wherein a detent is formed in one of said walls, said spring is a coil spring, and said spring is at least partially disposed in said detent.

3. A firearm auxiliary sight according to claim 1 wherein a sight base is pivotally mounted in said base mount.

4. A firearm auxiliary sight according to claim 3 wherein an opening is formed in said sight base and a sight aperture is disposed in said opening.

5. A firearm auxiliary sight according to claim 4 wherein said sight aperture is pivotally secured to said sight base and rotated upwardly by means of a spring.

6. A firearm auxiliary sight according to claim 1 wherein a finger extends from one end of said lever.

7. A firearm auxiliary sight according to claim 6 wherein an aperture is formed in one of said walls of said housing and said finger extends through said aperture formed in said wall.

8. A firearm auxiliary sight according to claim 7 wherein said finger is engageable with said base mount.

9. A firearm auxiliary sight according to claim 8 wherein said base mount comprises multiple upstanding walls, an aperture is formed in one of said upstanding walls, and said finger extends through said aperture formed in said one upstanding wall.

10. A firearm auxiliary sight according to claim 1 wherein a plate is disposed between one of said walls and said base mount.

11. A firearm auxiliary sight according to claim 10 wherein a pin extends from said base mount adjacent said plate.

12. A firearm auxiliary sight according to claim 11 wherein the lower edge of said plate is spaced from said bottom.

13. A firearm auxiliary sight according to claim 12 wherein said pin is disposed in said space between the lower edge of said plate and said bottom.

14. A firearm auxiliary sight according to claim 1 wherein an optical sight is attached to said firearm and spaced therefrom.

15. A firearm auxiliary sight according to claim 14 wherein said housing is secured to said firearm between said optical sight and said firearm.

16. A firearm auxiliary sight according to claim 1 wherein said edge of said bottom is disposed at an angle of approximately 45 degrees, said base mount comprises a bottom, and said bottom of said face mount is in face contacting relation with said edge.

* * * * *